US008879977B2

(12) United States Patent
Ogihara et al.

(10) Patent No.: US 8,879,977 B2
(45) Date of Patent: Nov. 4, 2014

(54) IMAGE FORMING APPARATUS AND IMAGE FORMING METHOD

(71) Applicant: Fuji Xerox Co., Ltd., Tokyo (JP)

(72) Inventors: Atsushi Ogihara, Kanagawa (JP); Tetsuji Okamoto, Kanagawa (JP); Koichi Watanabe, Kanagawa (JP); Wataru Suzuki, Kanagawa (JP); Shuichi Nishide, Kanagawa (JP); Masamichi Kimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 71 days.

(21) Appl. No.: 13/673,088

(22) Filed: Nov. 9, 2012

(65) Prior Publication Data

US 2013/0308991 A1 Nov. 21, 2013

(30) Foreign Application Priority Data

May 17, 2012 (JP) ..... 2012-113763

(51) Int. Cl.
*G03G 15/20* (2006.01)

(52) U.S. Cl.
USPC ..... 399/341; 399/334

(58) Field of Classification Search
CPC ..... G03G 2215/00805; G03G 2215/0081; G03G 15/6582
USPC ..... 399/341
See application file for complete search history.

(56) References Cited

U.S. PATENT DOCUMENTS

| | | | | |
|---|---|---|---|---|
| 5,089,363 | A * | 2/1992 | Rimai et al. | 430/124.13 |
| 5,499,088 | A * | 3/1996 | Menjo | 399/321 |
| 5,863,690 | A * | 1/1999 | Yamashita | 430/124.31 |
| 7,175,269 | B2 * | 2/2007 | Kito | 347/106 |
| 2011/0103855 | A1 | 5/2011 | Morikawa | |

FOREIGN PATENT DOCUMENTS

| | | | |
|---|---|---|---|
| JP | 09265243 | A * | 10/1997 |
| JP | 2006-163277 | A | 6/2006 |
| JP | 2011-099913 | A | 5/2011 |

* cited by examiner

*Primary Examiner* — Clayton E Laballe
*Assistant Examiner* — Leon W Rhodes, Jr.
(74) *Attorney, Agent, or Firm* — Sughrue Mion, PLLC

(57) ABSTRACT

An image forming apparatus includes an image forming unit that forms an image on a recording medium, a glossiness imparting unit that imparts glossiness to the image formed on the recording medium, and a glossiness reducing unit that reduces the glossiness of at least a part of the image to which the glossiness has been imparted by the glossiness imparting unit.

6 Claims, 10 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2012-113763 filed May 17, 2012.

BACKGROUND

Technical Field

The present invention relates to an image forming apparatus and an image forming method.

SUMMARY

According to an aspect of the invention, there is provided an image forming apparatus including an image forming unit that forms an image on a recording medium, a glossiness imparting unit that imparts glossiness to the image formed on the recording medium, and a glossiness reducing unit that reduces the glossiness of at least a part of the image to which the glossiness has been imparted by the glossiness imparting unit.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described with reference to the drawings.

First Exemplary Embodiment

Figure 1:
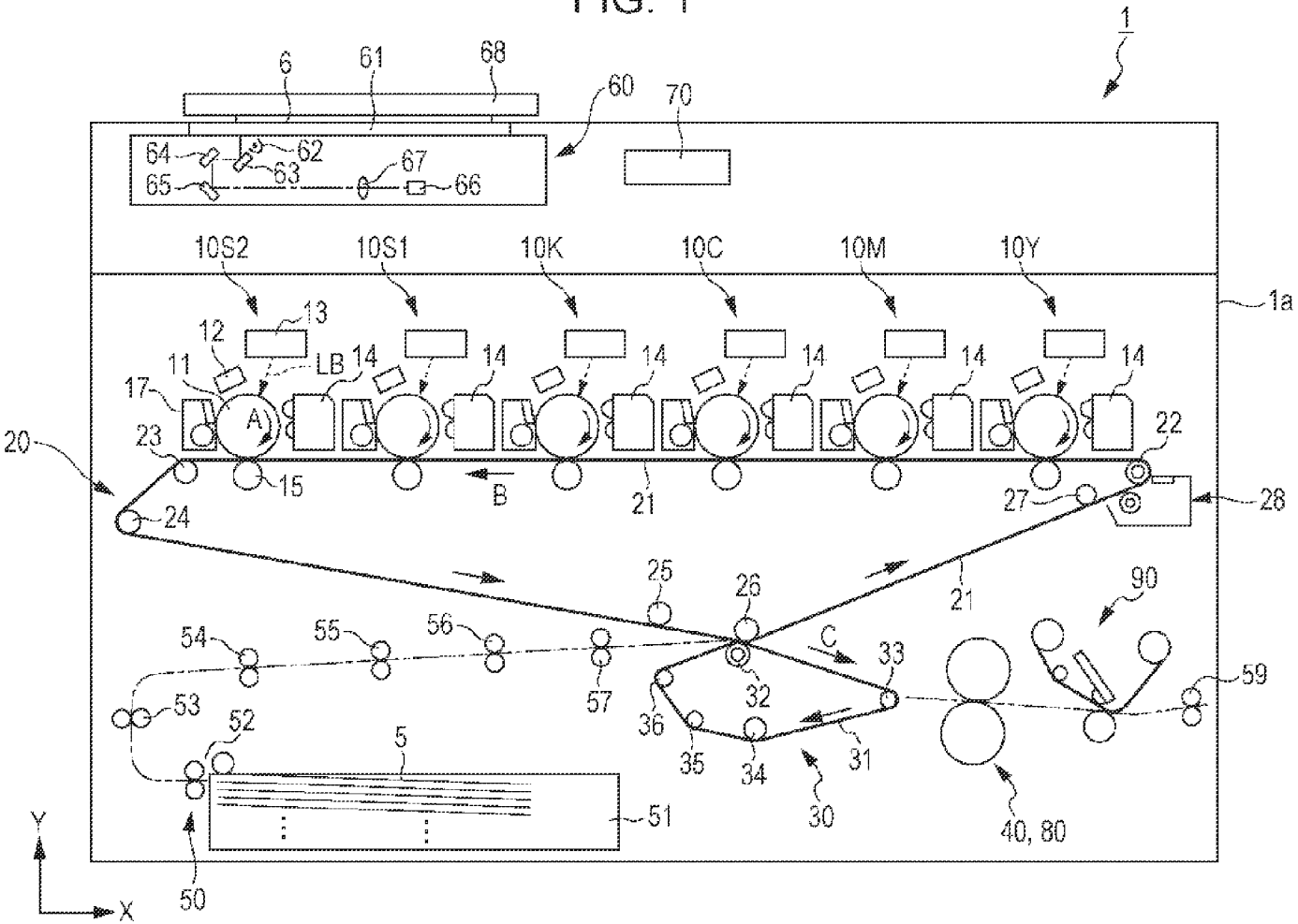
FIG. 1 illustrates the structure of an image forming apparatus according to an exemplary embodiment of the present invention.
Figure 2:
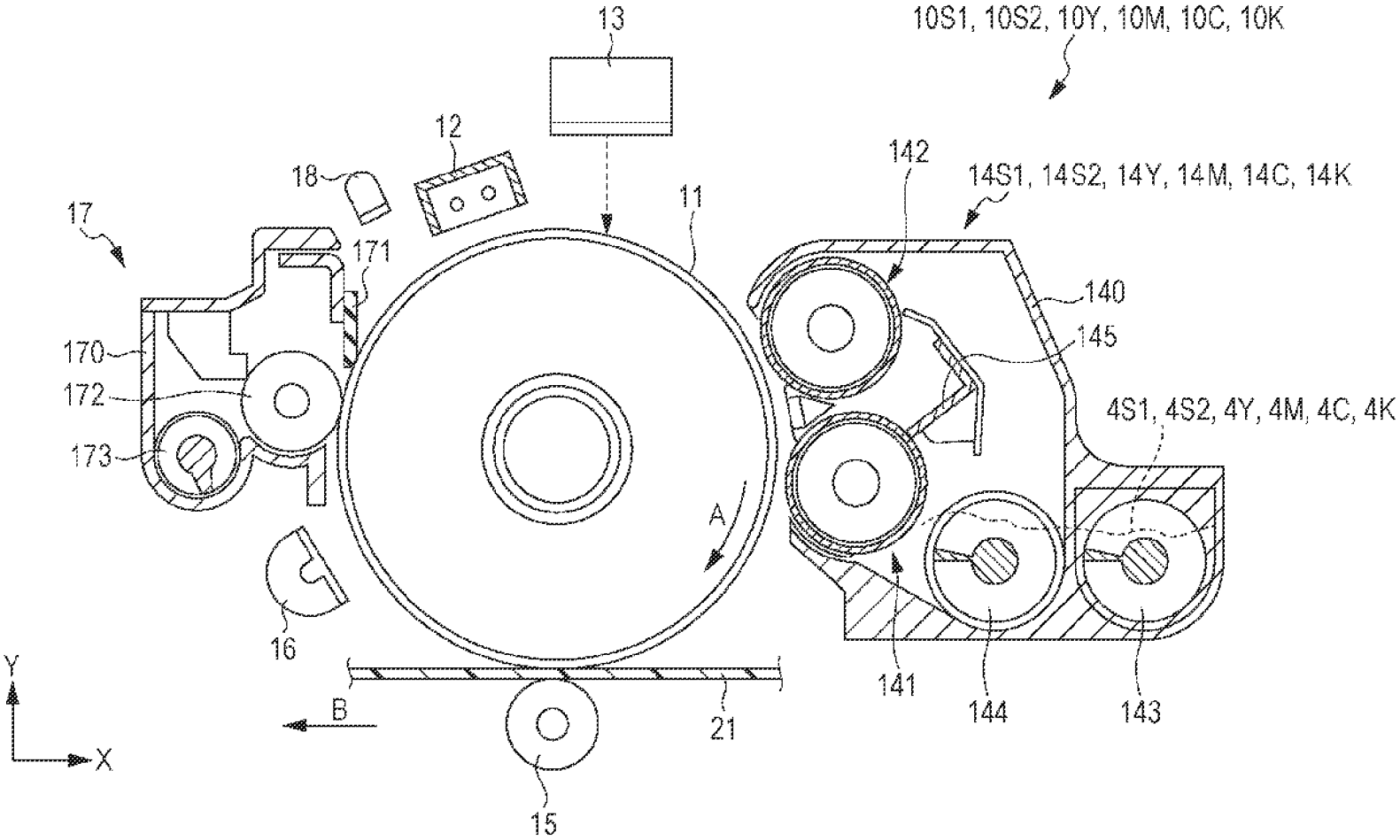
FIG. 2 illustrates the structure of a part of the image forming apparatus according to the exemplary embodiment of the present invention.

FIGS. 1 and 2 illustrate an image forming apparatus 1 according to a first exemplary embodiment. FIG. 1 illustrates the overall structure of the image forming apparatus 1, and FIG. 2 illustrates an enlarged view of a part (for example, imaging devices) of the image forming apparatus 1.

Overall Structure of Image Forming Apparatus

The image forming apparatus 1 according to the first exemplary embodiment is, for example, a color printer. The image forming apparatus 1 includes plural imaging devices 10, an intermediate transfer device 20, a paper feeding device 50, and a fixing device 40. Each imaging device 10 forms a toner image developed with toner contained in developer 4. The intermediate transfer device 20 carries toner images formed by the respective imaging devices 10 and transports the toner images to a second transfer position at which the toner images are transferred onto a sheet of recording paper 5, which is an example of a recording medium, in a second transfer process. The paper feeding device 50 contains and transports the sheet of recording paper 5 to be supplied to the second transfer position of the intermediate transfer device 20. The fixing device 40 fixes the toner images that have been transferred onto the sheet of recording paper 5 by the intermediate transfer device 20 in the second transfer process.

In the case where, for example, an image input device 60 that inputs a document image to be formed on the sheet of recording paper 5 is additionally provided, the image forming apparatus 1 may be configured as a color copier. Referring to FIG. 1, the image forming apparatus 1 includes a housing 1*a* including, for example, a supporting structural member and an external covering part. The one-dot chain line shows a transport path along which the sheet of recording paper 5 is transported in the housing 1*a*.

Structure of Part of Image Forming Apparatus

The imaging devices 10 include six imaging devices 10Y, 10M, 10C, 10K, 10S1, and 10S2. The imaging devices 10Y, 10M, 10C, and 10K respectively form toner images of four colors, which are yellow (Y), magenta (M), cyan (C), and black (K). The imaging devices 10S1 and 10S2 respectively form two types of toner images of special colors S1 and S2. The six imaging devices 10 (S1, S2, Y, M, C, and K) are arranged along a line in the inner space of the housing 1*a*. The developers 4 (S1 and S2) of the special colors (S1 and S2) contain, for example, materials of colors which are difficult or impossible to be expressed by the above-described four colors. More specifically, toners of colors other than the four colors, toners having the same colors as the four colors but saturations different from those of the toners of four colors, toners that increase the glossiness, foaming toners used in Braille printing, fluorescent toners, etc., may be used. The imaging devices 10 (S1, S2, Y, M, C, and K) have a substantially similar structure, as described below, except for the type of the developer used therein.

As illustrated in FIGS. 1 and 2, each imaging device 10 (S1, S2, Y, M, C, or K) includes a photoconductor drum 11 that rotates, and devices described below are arranged around the photoconductor drum 11. The devices include a charging device 12, an exposure device 13, a developing device 14 (S1, S2, Y, M, C, K), a first transfer device 15, a pre-cleaning charging device 16, a drum cleaning device 17, and a electricity removing device 18. The charging device 12 charges a peripheral surface (image carrying surface) of the photoconductor drum 11, on which an image may be formed, to a certain potential. The exposure device 13 irradiates the charged peripheral surface of the photoconductor drum 11 with light LB based on image information (signal) to form an electrostatic latent image (for the corresponding color) having a potential difference. The developing device 14 (S1, S2, Y, M, C, or K) forms a toner image by developing the electrostatic latent image with toner contained in the developer 4 of the corresponding color (S1, S2, Y, M, C, or K). The first transfer device 15 performs a first transfer process in which the toner image is transferred onto the intermediate transfer device 20. The pre-cleaning charging device 16 charges substances, such as toner, that remain on the image carrying surface of the photoconductor drum 11 after the first transfer process. The drum cleaning device 17 cleans the image carrying surface by removing the recharged substances. The electricity removing device 18 removes electricity from the image carrying surface of the photoconductor drum 11 after the cleaning process.

The photoconductor drum 11 includes a cylindrical or columnar base member that is grounded and a photoconductive layer (photosensitive layer) that is provided on the peripheral surface of the base member. The photoconductive layer is made of a photosensitive material and is provided with the image carrying surface. The photoconductor drum 11 is supported so as to be capable of rotating in the direction shown by arrow A when power is transmitted thereto from a rotation driving device (not shown).

The charging device 12 is a non-contact charging device, such as a corona discharger, and is arranged without contacting the photoconductor drum 11. The charging device 12 includes a discharge member that receives a charging voltage. In the case where the developing device 14 performs reversal development, a voltage or current having the same polarity as the charging polarity of the toner supplied by the developing device 14 is supplied as the charging voltage.

The exposure device 13 forms the electrostatic latent image by irradiating the charged peripheral surface of the photoconductor drum 11 with light (arrowed dashed line) LB generated in accordance with the image information input to the image forming apparatus 1. When forming the electrostatic latent image, the exposure device 13 receives the image information (signal) that is input to the image forming apparatus 1 by any method.

As illustrated in FIG. 2, each developing device 14 (S1, S2, Y, M, C, or K) includes a housing 140 having an opening and a chamber of the developer 4. Two developing rollers 141 and 142, two stirring-and-transporting members 143 and 144, and a layer-thickness regulating member 145 are disposed in the housing 140. The two developing rollers 141 and 142 hold the developer 4 and transport the developer 4 to respective developing areas in which the developing rollers 141 and 142 face the photoconductor drum 11. The stirring-and-transporting members 143 and 144 are, for example, two screw augers that transport the developer 4 while stirring the developer 4 so that the developer 4 passes between the developing rollers 141 and 142. The layer-thickness regulating member 145 regulates the amount (layer thickness) of the developer 4 held by the developing roller 142. A developing voltage supplied from a power supply device (not shown) is applied between the photoconductor drum 11 and the developing rollers 141 and 142 of the developing device 14. The developing rollers 141 and 142 and the stirring-and-transporting members 143 and 144 receive power from a rotation driving device (not shown) and rotates in a certain direction. Two-component developers containing nonmagnetic toner and magnetic carrier are used as the developers 4 (Y, M, C, and K) of the above-described four colors and the developers 4 (S1 and S2) of the two special colors.

The first transfer device 15 is a contact transfer device including a first transfer roller which rotates while contacting the periphery of the photoconductor drum 11 and receives a first transfer voltage. A direct-current voltage having a polarity opposite to the charging polarity of the toner is supplied as the first transfer voltage from the power supply device (not shown).

As illustrated in FIG. 2, the drum cleaning device 17 includes a container-shaped body 170 that has an opening, a cleaning plate 171, a rotating brush roller 172, and a transporting member 173. The cleaning plate 171 is arranged to contact the peripheral surface of the photoconductor drum 11 at a certain pressure after the first transfer process and clean the peripheral surface of the photoconductor drum 11 by removing substances such as residual toner therefrom. The rotating brush roller 172 is arranged to contact with the peripheral surface of the photoconductor drum 11 while rotating at a position upstream of the cleaning plate 171 in the rotation direction of the photoconductor drum 11. The transporting member 173 is, for example, a screw auger that transports the substances such as toner that have been removed by the cleaning plate 171 to a collecting system (not shown). The cleaning plate 171 may be formed of a plate-shaped member (for example, a blade) made of rubber or the like.

As illustrated in FIG. 1, the intermediate transfer device 20 is disposed below the imaging devices 10 (S1, S2, Y, M, C, and K). The intermediate transfer device 20 basically includes an intermediate transfer belt 21, plural belt support rollers 22 to 27, a second transfer device 30, and a belt cleaning device 28. The intermediate transfer belt 21 rotates in the direction shown by arrow B while passing through a first transfer position, which is between the photoconductor drum 11 and the first transfer device 15 (first transfer roller). The belt support rollers 22 to 27 retain the intermediate transfer belt 21 in a desired position at the inner surface of the intermediate transfer belt 21 so that the intermediate transfer belt 21 is rotatably supported. The second transfer device 30 is disposed to oppose the belt support roller 26 that supports the intermediate transfer belt 21 at the outer-peripheral-surface (image-carrying-surface) side of the intermediate transfer belt 21. The second transfer device 30 performs a second transfer process in which the toner images on the intermediate transfer belt 21 are transferred onto the sheet of recording paper 5. The belt cleaning device 28 cleans the outer peripheral surface of the intermediate transfer belt 21 by removing substances such as toner and paper dust that remain on the outer peripheral surface of the intermediate transfer belt 21 after the intermediate transfer belt 21 has passed the second transfer device 30.

The intermediate transfer belt 21 may be, for example, an endless belt made of a material obtained by dispersing a resistance adjusting agent, such as carbon black, in a synthetic resin, such as polyimide resin or polyamide resin. The belt support roller 22 serves as a driving roller. The belt support rollers 23, 25, and 27 serve as driven rollers for retaining the position of the intermediate transfer belt 21. The belt support roller 24 serves as a tension-applying roller. The belt support roller 26 serves as a back-up roller in the second transfer process.

As illustrated in FIG. 1, the second transfer device 30 includes a second transfer belt 31 and plural support rollers 32 to 36. The second transfer belt 31 rotates in the direction shown by arrow C while passing through a second transfer position, which is on the outer-peripheral-surface side of the intermediate transfer belt 21 that is supported by the belt support roller 26 in the intermediate transfer device 20. The support rollers 32 to 36 retain the second transfer belt 31 in a desired position at the inner surface of the second transfer belt 31 so that the second transfer belt 31 is rotatably supported. The second transfer belt 31 is, for example, an endless belt having substantially the same structure as that of the above-described intermediate transfer belt 21. The belt support roller 32 is arranged so that the second transfer belt 31 is pressed at a certain pressure against the outer peripheral surface of the intermediate transfer belt 21 supported by the belt support roller 26. The belt support roller 32 serves as a driving roller, and the belt support roller 36 serves as a tension-applying roller. The belt support roller 32 of the second transfer device 30 or the belt support roller 26 of the intermediate transfer device 20 receives a direct-current voltage having a polarity that is opposite to or the same as the charging polarity of the toner as a second transfer voltage.

The fixing device 40 includes a drum-shaped heating rotating body 42 and a pressing rotating body 43 that are arranged in a housing 41 having an inlet and an outlet for the sheet of recording paper 5. The heating rotating body 42 rotates in the direction shown by the arrow and is heated by a heater so that the surface temperature thereof is maintained at a predetermined temperature. The pressing rotating body 43 is drum-shaped and contacts the heating rotating body 42 at a certain pressure substantially along the axial direction of the heating rotating body 42, so that the pressing rotating body 43 is rotated. In the fixing device 40, the contact portion in which the heating rotating body 42 and the pressing rotating body 43 contact each other serves as a fixing process unit that performs a certain fixing process (heating and pressing).

The paper feeding device 50 is disposed below the intermediate transfer device 20 and the second transfer device 30. The paper feeding device 50 basically includes at least one paper container 51 that contains sheets of recording paper 5 of the desired size, type, etc., in a stacked manner and a transporting device 52 that feeds the sheets of recording paper 5 one at a time from the paper container 51. The paper container 51 is, for example, attached to the housing 1*a* such that the paper container 51 may be pulled out therefrom at the front side (side that faces the user during operation) of the housing 1*a*.

Plural pairs of paper transport rollers 53 to 57, which transport each of the sheets of recording paper 5 fed from the paper feeding device 50 to the second transfer position, and a paper transport path including transport guides (not shown) are provided between the paper feeding device 50 and the second transfer device 30. The pair of paper transport rollers 57 that are disposed immediately in front of the second transfer position on the paper transport path serve as, for example, registration rollers for adjusting the time at which each sheet of recording paper 5 is to be transported. A paper transport device 58, which may be belt-shaped, is provided between the second transfer device 30 and the fixing device 40. The paper transport device 58 transports the sheet of recording paper 5 that has been transported from the second transfer belt 31 of the second transfer device 30 after the second transfer process to the fixing device 40. A pair of paper discharge rollers 59 are disposed near a paper outlet formed in the housing 1*a*. The pair of paper discharge rollers 59 discharge the sheet of recording paper 5 that has been subjected to the fixing process and transported from the fixing device 40 to the outside of the housing 1*a*.

The image input device 60, which is provided when the image forming apparatus 1 is formed as a color copier, is an image reading device that reads an image of a document 6 having the image information to be printed. The image input device 60 is arranged, for example, above the housing 1*a* as illustrated in FIG. 1. The image input device 60 basically includes a document receiving plate (platen glass) 61, a light source 62, a reflection mirror 63, a first reflection mirror 64, a second reflection mirror 65, an image reading element 66, and an imaging lens 67. The document receiving plate 61 includes, for example, a transparent glass plate on which the document 6 having the image information to be read is placed. The light source 62 irradiates the document 6 placed on the document receiving plate 61 while moving. The reflection mirror 63 receives reflected light from the document 6 and reflects the light in a predetermined direction while moving together with the light source 62. The first and second reflection mirrors 64 and 65 move at a predetermined speed by a predetermined distance with respect to the reflection mirror 63. The image reading element 66 includes, for example, a charge coupled device (CCD) that receives and reads the reflected light from the document 6 and converts the reflected light into an electrical signal. The imaging lens 67 focuses the reflected light on the image reading element 66. Referring to FIG. 1, the document receiving plate 61 is covered by an opening-closing covering part 68.

The image information of the document 6 that has been read by the image input device 60 is input to an image processing device 70, which subjects the image information to necessary image processing. The image input device 60 transmits the read image information of the document 6 to the image processing device 70 as, for example, red (R), green (G), and blue (B) three-color image data (for example, 8-bit data for each color). The image processing device 70 subjects the image data transmitted from the image input device 60 to predetermined image processing, such as shading correction, misregistration correction, brightness/color space conversion, gamma correction, frame erasing, and color/movement edition. The image processing device 70 converts the image signals obtained as a result of the image processing into image signals of the above-described four colors (Y, M, C, and K), and transmits the image signals to the exposure device 13. The image processing device 70 also generates image signals for the two special colors (S1 and S2).

Operation of Image Forming Apparatus

A basic image forming operation performed by the image forming apparatus 1 will now be described.

First, an image forming operation for forming a full-color image by combining toner images of four colors (Y, M, C, and K) by using the four imaging devices 10 (Y, M, C, and K) will be described.

When the image forming apparatus 1 receives command information of a request for the image forming operation (printing), the four imaging devices 10 (Y, M, C, and K), the intermediate transfer device 20, the second transfer device 30, and the fixing device 40 are activated.

In each of the imaging devices 10 (Y, M, C, and K), first, the photoconductor drum 11 rotates in the direction shown by arrow A and the charging device 12 charges the surface of the photoconductor drum 11 to a certain potential with a certain polarity (negative polarity in the first exemplary embodiment). Subsequently, the exposure device 13 irradiates the charged surface of the photoconductor drum 11 with the light LB based on the image signal obtained by converting the image information input to the image forming apparatus 1 into a component of the corresponding color (Y, M, C, or K). As a result, an electrostatic latent image for the corresponding color having a certain potential difference is formed on the surface of the photoconductor drum 11.

After that, each of the imaging devices 10 (Y, M, C, and K) supplies the toner of the corresponding color (Y, M, C, or K), charged with a certain polarity (negative polarity), from the developing rollers 141 and 142 to the electrostatic latent image of the corresponding color formed on the photoconductor drum 11. The toner electrostatically adheres to the electrostatic latent image, so that the electrostatic latent image is developed. As a result of the developing process, the electrostatic latent images for the respective colors formed on the photoconductor drums 11 are visualized as toner images of the four colors (Y, M, C, and K) developed with the toners of the respective colors.

When the toner images of the respective colors formed on the photoconductor drums 11 of the imaging devices 10 (Y, M, C, and K) reach the respective first transfer positions, the first transfer devices 15 perform the first transfer process so that the toner images of the respective colors are successively transferred, in a superimposed manner, onto the intermediate transfer belt 21 of the intermediate transfer device 20 that rotates in the direction of arrow B.

In each imaging device 10, after the first transfer process, the pre-cleaning charging device 16 recharges the substances, such as toner, that remain on the surface of the photoconductor drum 11 after the first transfer process. Subsequently, the drum cleaning device 17 cleans the surface of the photoconductor drum 11 by scraping off the recharged substances, and the electricity removing device 18 removes the electricity from the cleaned surface of the photoconductor drum 11. Thus, the imaging device 10 is set to a standby state for the next imaging operation.

In the intermediate transfer device 20, the intermediate transfer belt 21 rotates so as to transport the toner images that have been transferred onto the intermediate transfer belt 21 by the first transfer process to the second transfer position. The paper feeding device 50 feeds a sheet of recording paper 5 to the paper transport path in accordance with the imaging operation. In the paper transport path, the pair of paper transport rollers 57, which serve as registration rollers, transport the sheet of recording paper 5 to the second transfer position in accordance with the transfer timing.

At the second transfer position, the second transfer device 30 performs the second transfer process in which the toner images on the intermediate transfer belt 21 are simultaneously transferred onto the sheet of recording paper 5. In the intermediate transfer device 20 after the second transfer process, the belt cleaning device 28 cleans the surface of the intermediate transfer belt 21 by removing the substances, such as toner, that remain on the surface after the second transfer process.

The sheet of recording paper 5, onto which the toner images have been transferred by the second transfer process, is released from the intermediate transfer belt 21 and from the second transfer belt 31 and transported to the fixing device 40 by the paper transport device 58. In the fixing device 40, the sheet of recording paper 5 after the second transfer process is guided through the contact portion between the heating rotating body 42 and the pressing rotating body 43 that rotate. Thus, a fixing process (heating and pressing) is performed so that the unfixed toner images are fixed to the sheet of recording paper 5. In the case where the image forming operation is performed to form an image only on one side of the sheet of recording paper 5, the sheet of recording paper 5 that has been subjected to the fixing process is discharged to, for example, a discharge container (not illustrated) disposed outside the housing 1*a* by the paper discharge rollers 59.

As a result of the above-described operation, the sheet of recording paper 5 on which a full-color image is formed by combining toner images of four colors is output.

Next, the case will be described in which special-color toner images are additionally formed by using the developers of the special colors S1 and S2 in the above-described normal image forming operation performed by the image forming apparatus 1.

In this case, first, the imaging devices 10S1 and 10S2 perform an operation similar to the imaging operation performed by the imaging devices 10 (Y, M, C, and K). Accordingly, special-color toner images (S1 and S2) are formed on the photoconductor drums 11 of the imaging devices 10S1 and 10S2. Subsequently, similar to the manner in which the toner images of the four colors are processed in the above-described image forming operation, the special-color toner images formed by the imaging devices 10S1 and 10S2 are transferred onto the intermediate transfer belt 21 of the intermediate transfer device 20 in the first transfer process. Then, in the second transfer process, the second transfer device 30 transfers the special-color toner images from the intermediate transfer belt 21 onto the sheet of recording paper 5 together with the toner images of the other colors. Lastly, the sheet of recording paper 5, onto which the special-color toner images and the toner images of the other colors have been transferred in the second transfer process, is subjected to the fixing process performed by the fixing device 40 and discharged to the outside of the housing 1*a*.

As a result of the above-described operation, the sheet of recording paper 5 is output on which the two special-color toner images overlap with a part or the entirety of the full-color image formed by combining the toner images of four colors together.

In the case where the image forming apparatus 1 is equipped with the image input device 60 and serves as a color copier, a basic image forming operation is performed as follows.

That is, in this case, when the document 6 is set to the image input device 60 and command information of a request for the image forming operation (copying) is input, the image input device 60 reads the document image from the document 6. The information of the read document image is subjected to the above-described image processing performed by the image processing device 70, so that the image signals are generated. The image signals are transmitted to the exposure devices 13 of the imaging devices 10 (S1, S2, Y, M, C, and K). Accordingly, each imaging device 10 forms an electrostatic latent image and a toner image based on the image information of the document 6. After that, an operation similar to the above-described image forming operation (printing) is performed and the sheet of recording paper 5 on which an image obtained by combining the toner images together is formed is output.

Structure of Glossiness Imparting Device

In the present exemplary embodiment, a glossiness imparting device 80 and a glossiness reducing device 90 are provided. The glossiness imparting device 80 imparts glossiness to the image formed on the sheet of recording paper 5. The glossiness reducing device 90 reduces the glossiness of at least a part of the image to which the glossiness has been imparted.

Figure 3:
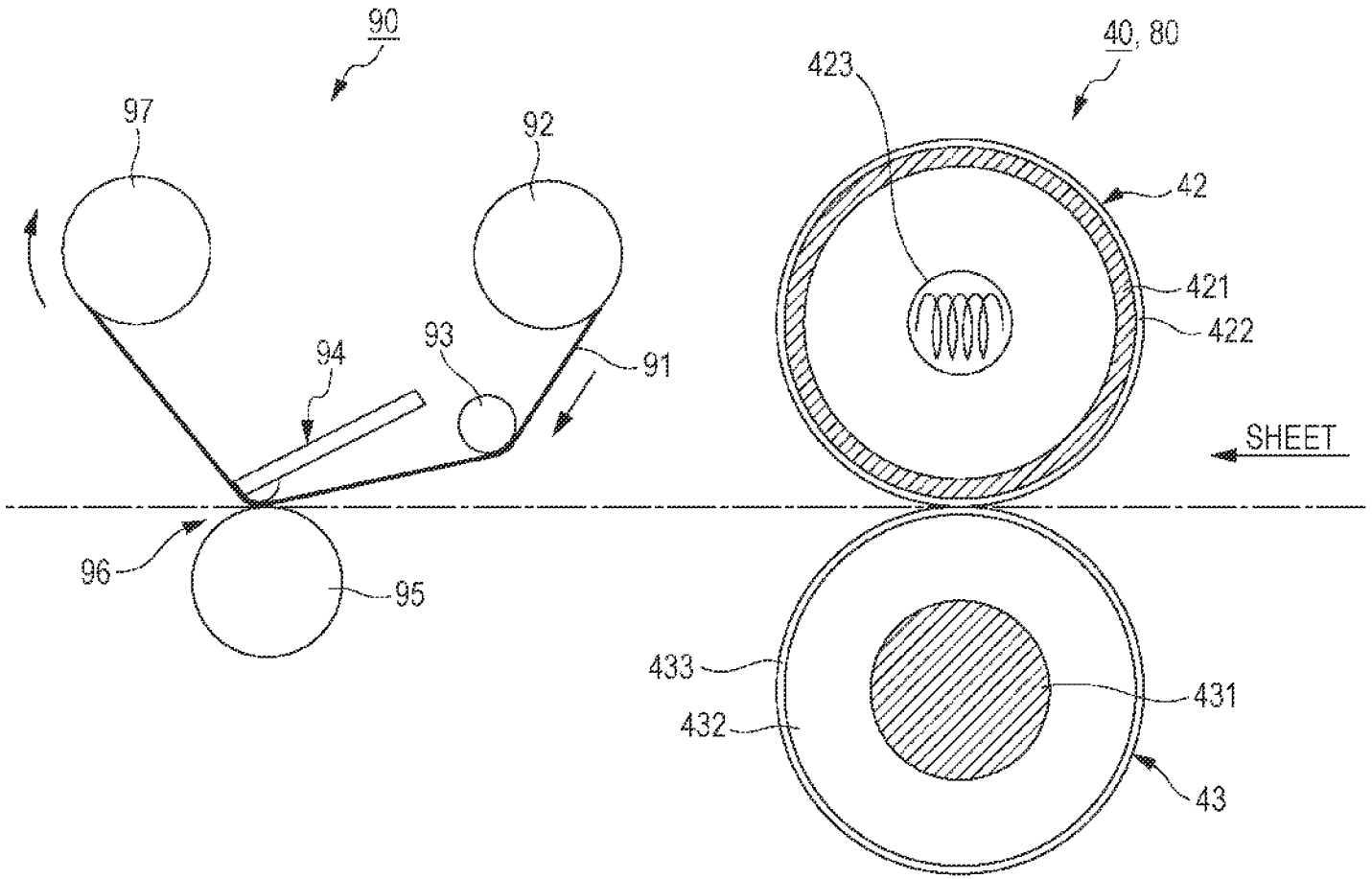
FIG. 3 is a schematic diagram illustrating a glossiness imparting device and a glossiness reducing device.

The glossiness imparting device 80 is formed of the fixing device 40. As illustrated in FIG. 3, the fixing device 40 includes a heating roller 42, which is an example of the heating rotating body, and a pressing roller 43, which is an example of a pressing rotating body. The heating roller 42 includes a cylindrical core bar 421 made of metal and a release layer 422 that covers a surface of the core bar 421 and that is made of, for example, polytetrafluoroethylene (PTFE) or tetrafluoroethylene-perfluoroalkoxyethylene copolymer (PFA). The surface of the release layer 422 is mirror-polished, and is formed as a mirror surface or a surface close to a mirror surface. A heat source 423 formed of, for example, a halogen lamp, is disposed in the heating roller 42, and the heating roller 42 is heated so that the surface temperature thereof is maintained at a predetermined temperature. When, for example, it is difficult to impart sufficient glossiness to the toner image on the sheet of recording paper 5 with the fixing device 40, the glossiness imparting device 80 may be provided separately from the fixing device 40 at a position downstream of the fixing device 40 in the transporting direction of the sheet of recording paper 5.

The pressing roller 43 includes a columnar or cylindrical core bar 431 made of metal, a relatively thick heat-resistant elastic layer 432 that covers a surface of the core bar 431 and that is made of, for example, a silicone rubber, and a release layer 433 that covers a surface of the elastic layer 432 and that is made of, for example, polytetrafluoroethylene (PTFE) or tetrafluoroethylene-perfluoroalkoxyethylene copolymer (PFA). The pressing roller 43 is pressed against the heating roller 42 at a predetermined pressure by a pressing unit (not shown).

Structure of Glossiness Reducing Device

Glossiness is imparted to the entire area of the toner image when the toner image is fixed to the sheet of recording paper 5 by the fixing device 40. Then, the glossiness reducing device 90 reduces the glossiness of at least a part of the toner image by heating and roughening the surface of the part of the toner image.

As illustrated in FIG. 3, the glossiness reducing device 90 is disposed on the downstream of the fixing device 40 in the transporting direction of the sheet of recording paper 5. The glossiness reducing device 90 includes a long film-shaped surface roughening film 91 that has a roughened surface. The surface roughening film 91 is supplied from a supply roller 92 around which the surface roughening film 91 is wound in a roll shape. The surface roughening film 91 is transported to a contact position 96, at which a heating device 94 is in contact with a back support roller 95, via a relay roller 93, and is then wound around a take-up roller 97. The take-up roller 97 is rotated in the direction shown by the arrow by a drive source (not shown), and takes up the surface roughening film 91 at a speed that is substantially equal to or slightly lower than the transporting speed of the fixing device 40.

The surface roughening film 91 has the shape of a long film with substantially the same width as that of the sheet of recording paper 5 having the maximum size, and is made of, for example, a heat resistant synthetic resin, such as polyethylene terephthalate (PET), polyimide (PI), or polyamideimide (PAI). The thickness of the surface roughening film 91 is not particularly limited, and may be in the range of, for example, 5 to 100 μm. In the present exemplary embodiment, a polyethylene terephthalate (PET) film having a thickness of 20 μm is used as the surface roughening film 91. A release layer made of, for example, polytetrafluoroethylene (PTFE) or tetrafluoroethylene-perfluoroalkoxyethylene copolymer (PFA) may be formed on a surface of the surface roughening film 91.

A surface of the surface roughening film 91 that comes into contact with the toner image fixed to the sheet of recording paper 5 is roughened. The roughening process is performed by, for example, blasting or thermal spraying. The surface roughness of the surface roughening film 91 is determined depending on the extent to which the glossiness of the toner image is reduced. For example, the arithmetical mean roughness Ra is set to about 0.1 to 5 μm. In the present exemplary embodiment, the surface roughness (Ra) of the surface roughening film 91 is set to about 1 μm. As the surface roughness (Ra) of the surface roughening film 91 increases, the glossiness of the toner image fixed to the sheet of recording paper 5 decreases.

Figure 4:
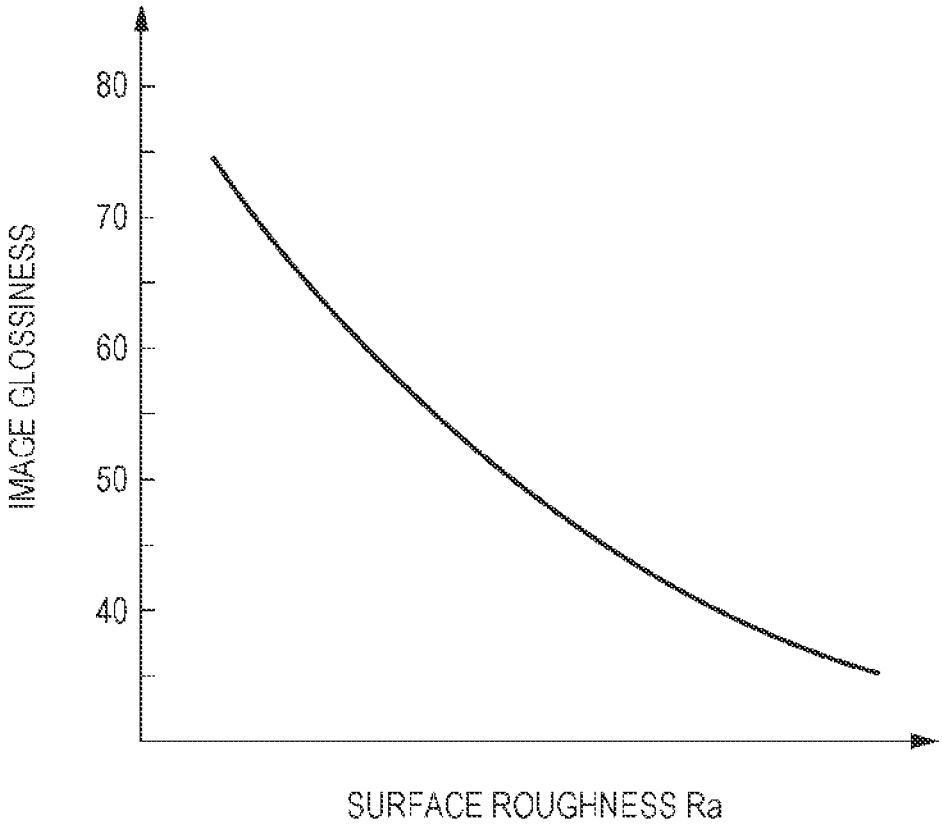
FIG. 4 is a graph showing the relationship between the surface roughness and the image glossiness.

FIG. 4 shows the relationship between the surface roughness Ra of the surface roughening film 91 and the image glossiness. As the surface roughness Ra of the surface roughening film 91 increases, the image glossiness decreases. When a color image is formed by fixing a toner image in which the image density of each of three colors, yellow (Y), magenta (M), and cyan (C), is 100% and glossiness of the color image is measured by, for example, "Micro-gloss 4460" produced by BYK Gardner Inc. at a measurement angle of 60°, the value of glossiness is 70 or more.

Figure 5:
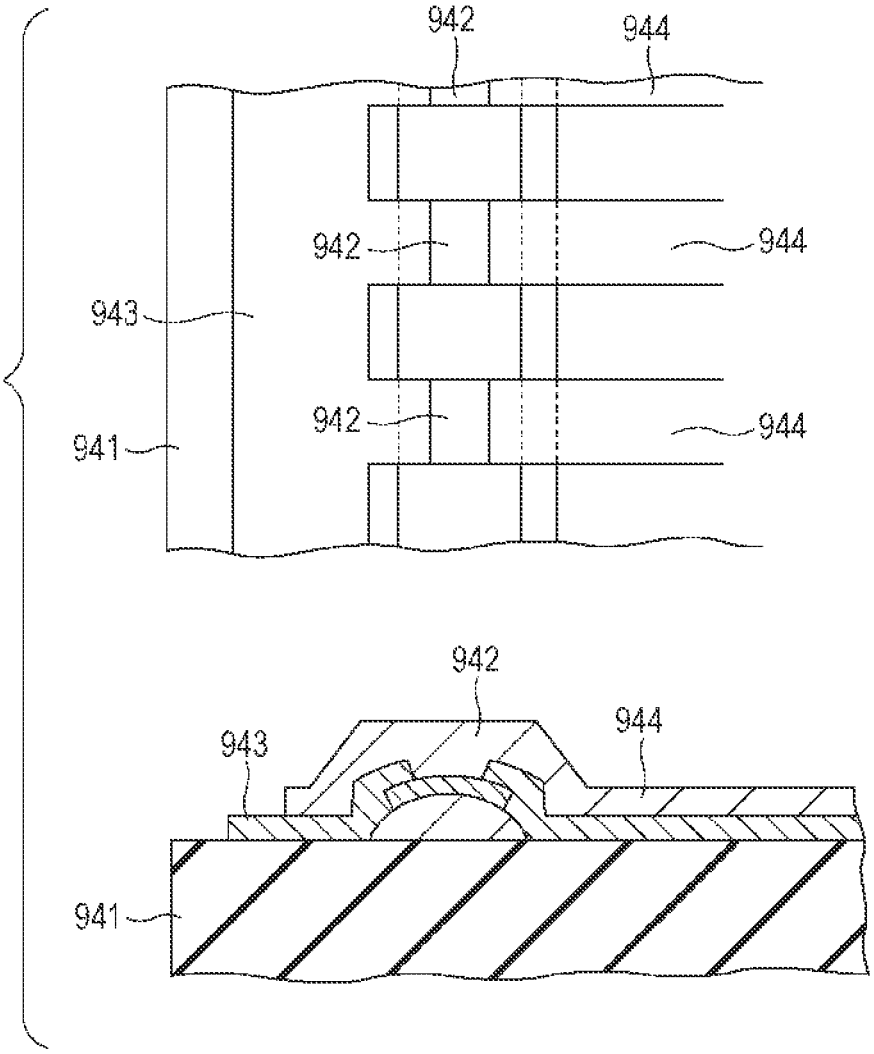
FIG. 5 illustrates a heating device.

The heating device 94 includes heating elements that are linearly arranged with predetermined intervals therebetween in a direction that crosses the transporting direction of the sheet of recording paper 5. The heating device 94 may be, for example, a thermal head. As illustrated in FIG. 5, the heating device 94 includes a plate-shaped insulating substrate 941 and plural heating elements 942 provided on a surface of the insulating substrate 941 at an end thereof. The heating elements 942 are arranged along a direction that crosses the transporting direction of the sheet of recording paper 5 (direction perpendicular to the plane of the lower diagram of FIG. 5) in accordance with the pixel density. Electricity is supplied to the heating elements 942 through a common electrode 943 and individual electrodes 944 in accordance with a signal output from a drive circuit (not shown). As a result, each heating element 942 generates heat. The surface roughening film 91 is heated by each heating element 942 of the heating device 94 to about 150° C. to 170° C., at which the toners melt.

Figure 6:
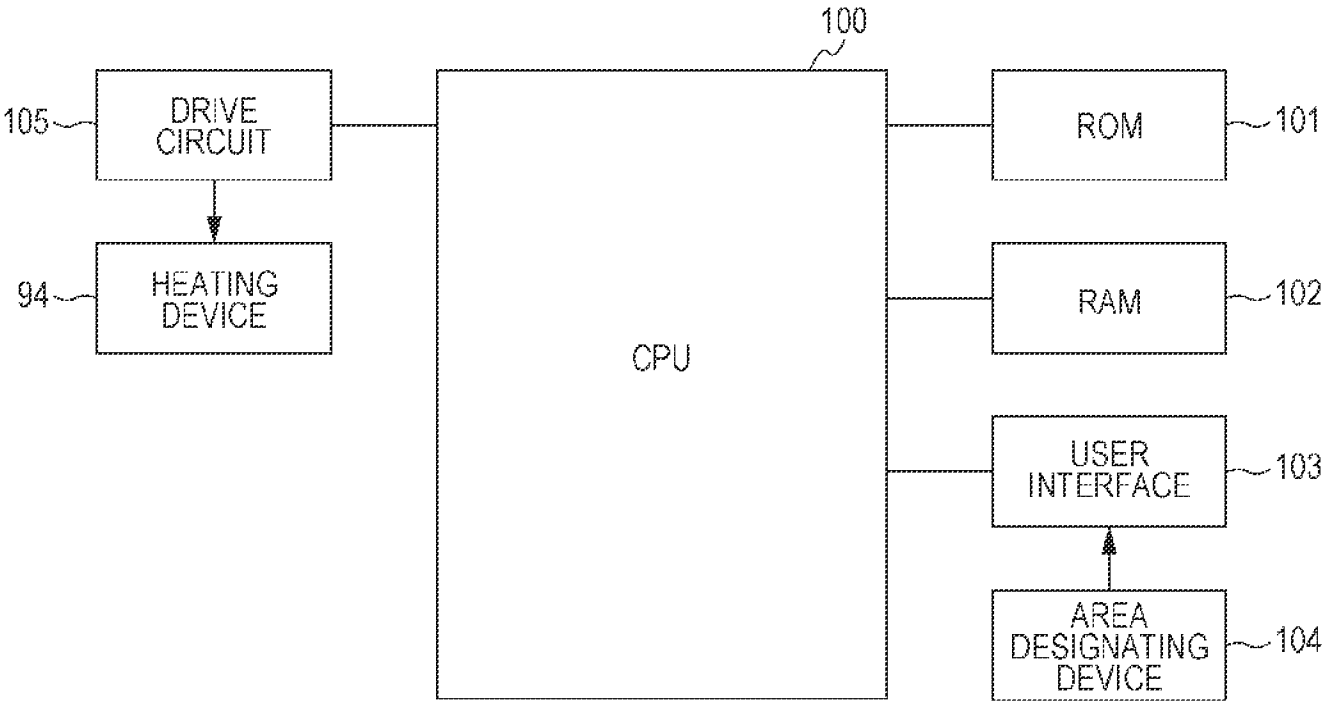
FIG. 6 is a block diagram illustrating a control circuit.

FIG. 6 is a block diagram illustrating a control circuit of the image forming apparatus according to the present exemplary embodiment.

Referring to FIG. 6, a CPU 100 serves as a control unit and controls the operation of the image forming apparatus on the basis of programs stored in a ROM 101 and parameters stored in a RAM 102.

A user uses a user interface 103 to select the type of sheets of recording paper 5 or set the number of sheets before the operation of the image forming apparatus. The user interface 103 includes an area designating device 104 that is formed of a touch panel or the like and used to designate an area in which the glossiness of the sheet of recording paper 5 is to be reduced. The area designating device 104 may be configured such that a rectangular area may be designated by inputting coordinates of points on a diagonal line of the area in which the glossiness of the sheet of recording paper 5 is to be reduced. In the case where the area designating device 104 is a touch panel, the user may designate a rectangular or irregular shaped area in which the glossiness of the sheet of recording paper 5 is to be reduced by pressing the area with a pen or the like.

The CPU 100 includes a drive circuit 105 that drives the heating device 94 of the glossiness reducing device 90. To heat the area designated by the area designating device 104, the CPU 100 causes the heating elements of the heating device 94 that correspond to the designated area to generate heat by using the drive circuit 105.

Operation of Glossiness Imparting Device

The operation of the fixing device 40 that serves also as the glossiness imparting device 80 will now be described.

In the image forming apparatus 1, as illustrated in FIG. 1, the toner image formed by the four imaging devices 10 (Y, M, C, K) of yellow (Y), magenta (M), cyan (C), and black (K) is transferred onto the sheet of recording paper 5 from the intermediate transfer belt 21 in the second transfer process performed by the second transfer device 30.

After the sheet of recording paper 5 is released from the second transfer device 30, the toner image that has been transferred onto the sheet of recording paper 5 is fixed to the sheet of recording paper 5 by being heated and pressed while the sheet of recording paper 5 passes through a pressure contact portion in which the heating roller 42 and the pressing roller 43 of the fixing device 40 are in pressure contact with each other.

At this time, the toner image on the sheet of recording paper 5 is melted by the heat applied by the heating roller 42, so that the fixed image has a mirror surface or a surface close to a mirror surface that corresponds to the mirror-polished surface of the release layer 422 provided at the periphery of the heating roller 42. Thus, glossiness is imparted to the fixed image.

Operation of Glossiness Reducing Device

The operation of the glossiness reducing device 90 will now be described.

Figure 7:
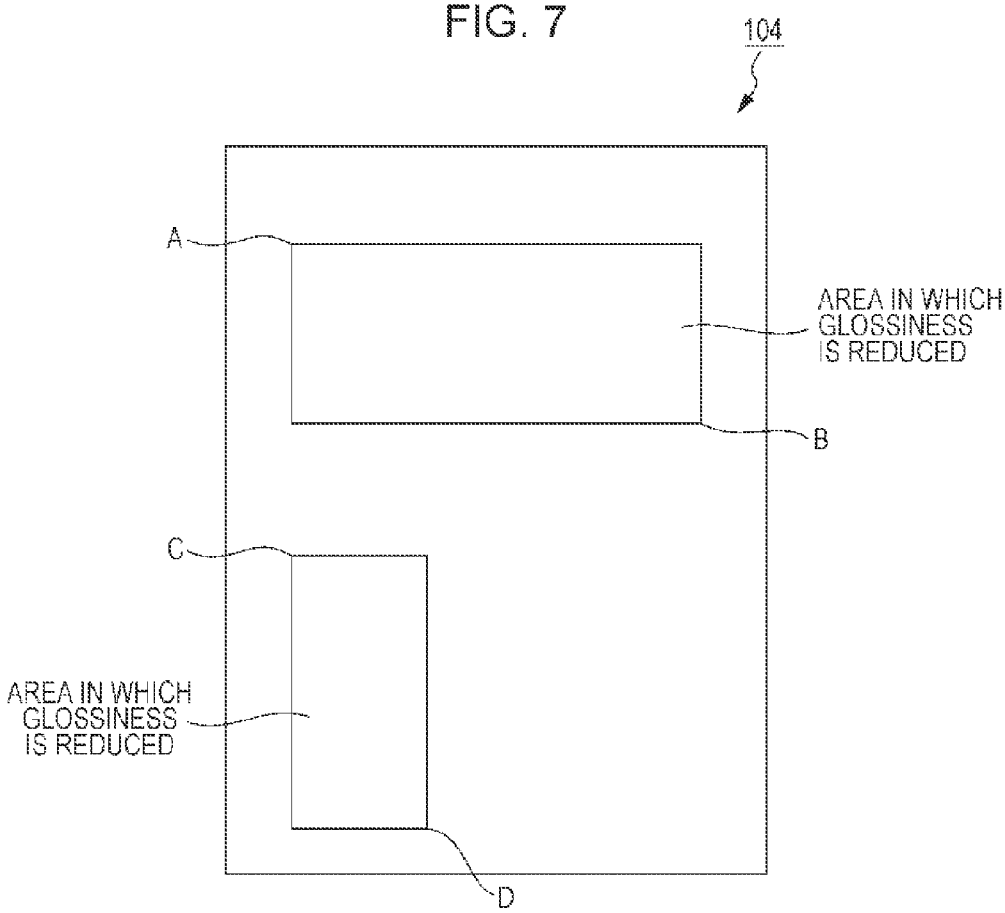
FIG. 7 is a schematic diagram illustrating an area designating device.

Before the image forming operation is started, the user designates an area in which the glossiness is to be reduced in the image formed on the sheet of recording paper 5 by operating the user interface 103. The area in which the glossiness is to be reduced is designated as follows. That is, as illustrated in FIG. 7, the user designates an area in which the glossiness is to be reduced in the image formed on the sheet of recording paper 5 by operating the area designating device 104 included in the user interface 103. The user may designate a rectangular area in which the glossiness is to be reduced by pressing the area designating device 104 at two points on a diagonal line of the area.

Figure 8:
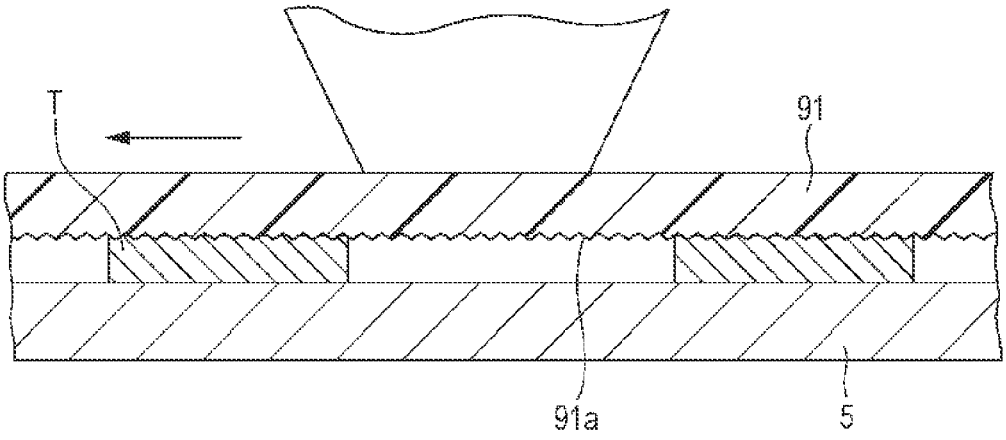
FIG. 8 is a sectional view illustrating an operation of an image forming apparatus according to a first exemplary embodiment of the present invention.

The fixing device 40 fixes the toner image to the sheet of recording paper 5 and imparts glossiness to the entire area of the toner image. Then, the sheet of recording paper 5 passes through the contact position 96 at which the heating device 94 and the back support roller 95 are in contact with each other. At this time, a part of the toner image fixed to the sheet of recording paper 5 is melted by being heated by the heating elements included in the heating device 94, the part being located in the area designated by the area designating device 104. As illustrated in FIG. 8, the melted part of the toner image T on the sheet of recording paper 5 is in contact with a roughened surface 91*a* of the surface roughening film 91. Therefore, the surface of the part of the toner image T changes to a surface that corresponds to the roughened surface 91*a* of the surface roughening film 91. Subsequently, the sheet of recording paper 5 is separated from the surface roughening film 91, and the part of the toner image T is solidified while the surface thereof has a shape that corresponds to that of the roughened surface 91*a* of the surface roughening film 91. As a result, the glossiness is reduced. After that, the sheet of recording paper 5 having the toner image T that has been roughened to reduce the glossiness in a desired area of the toner image T is ejected to the outside of the housing 1*a* of the image forming apparatus 1. The glossiness of the part of the toner image T that has not been heated by the heating device 94 is not reduced.

As described above, in the above-described exemplary embodiment, the unfixed toner image T that has been transferred onto the sheet of recording paper 5 is subjected to the fixing process in which the toner image T is heated and pressed by the fixing device 40, so that the toner image T is fixed to the sheet of recording paper 5. The entire area of the toner image T has a mirror surface or a surface close to a mirror surface that corresponds to the surface of the heating roller 42. Thus, glossiness is imparted to the entire area of the toner image T.

After glossiness is imparted to the entire area of the toner image T on the sheet of recording paper 5, the sheet of recording paper 5 is transported to the glossiness reducing device 90. In the glossiness reducing device 90, only the area that has been designated by the user is selectively heated by the heating elements 942 of the heating device 94 so that the toner image T is melted and comes into contact with the surface 91*a* of the surface roughening film 91.

As a result, only a part of the toner image T on the sheet of recording paper 5 is roughened by coming into contact with the roughened surface 91*a* of the surface roughening film 91, the part being located in the area designated by the area designating device 104. Thus, the glossiness of the part of the toner image T is reduced.

Since the toner image T on the sheet of recording paper 5 is previously subjected to the fixing process performed by the fixing device 40, the toner image T has a satisfactory color developability and may be reliably fixed to the sheet of recording paper 5 also in the area in which the surface is roughened. Therefore, the risk that the fixing performance of the toner image T on the sheet of recording paper 5 will be reduced in the area in which the glossiness is reduced may be reduced or eliminated.

In addition, the glossiness reducing device 90 simply causes the toner image T on the sheet of recording paper 5 to come into contact with the surface roughening film 91 while partially heating the toner image T. Therefore, the glossiness may be reduced in the desired area by using a simple structure.

Second Exemplary Embodiment

Figure 9A:
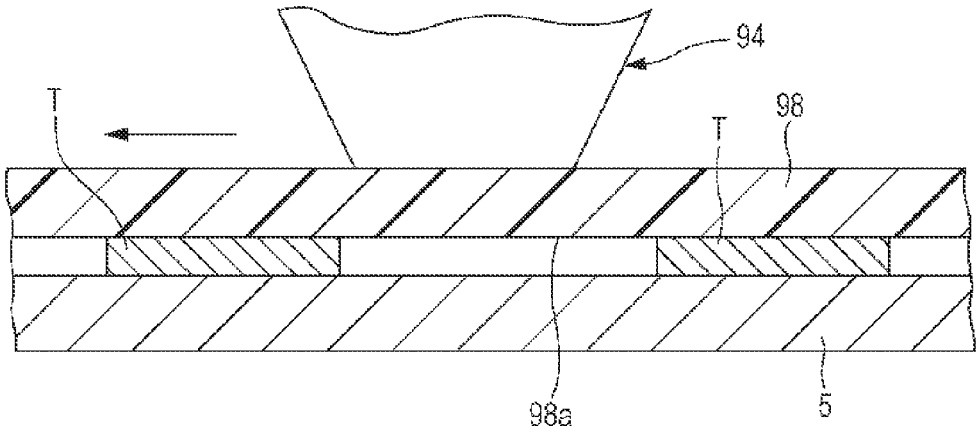
FIGS. 9A and 9B are sectional views illustrating an operation of an image forming apparatus according to a second exemplary embodiment of the present invention.
Figure 9B:
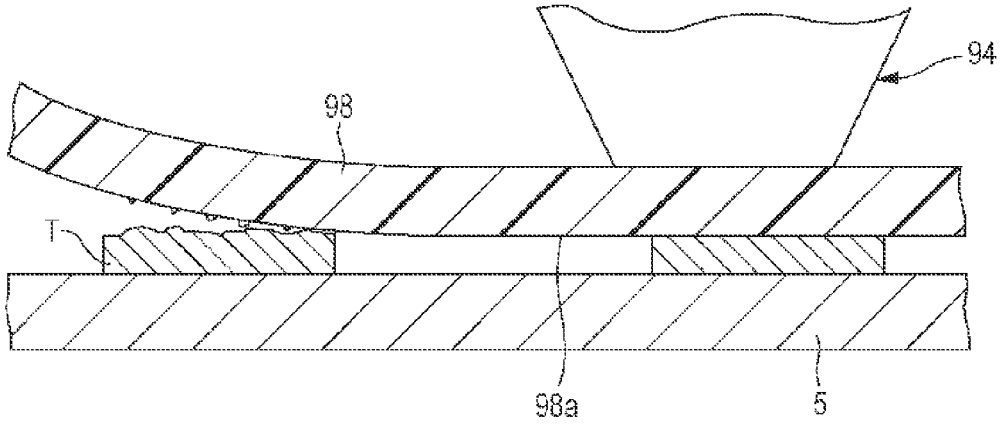

FIGS. 9A and 9B illustrate a part of an image forming apparatus according to a second exemplary embodiment.

Structure of Glossiness Reducing Device

In an image forming apparatus 1 according to the second exemplary embodiment, the glossiness reducing device does not include the surface roughening film 91 having a roughened surface, and releasability of a surface of a glossiness reducing unit that comes into contact with an image is set to be lower than that of a surface of a glossiness imparting unit that comes into contact with the image.

The glossiness reducing device includes a low releasability film 98, which has a surface with a low releasability, in place of the surface roughening film 91. The low releasability film 98 has the shape of a long film with substantially the same width as that of the sheet of recording paper 5 having the maximum size, and is made of, for example, a heat resistant synthetic resin, such as polyethylene terephthalate (PET), polyimide (PI), or polyamideimide (PAI).

The releasability of the low releasability film 98 is determined by the surface energy of the material that forms the low releasability film 98. In the present exemplary embodiment, the low releasability film 98, which is made of the synthetic resin, is used without forming a release layer on the surface thereof. Therefore, the releasability of a surface 98*a* of the glossiness reducing device 90 that comes into contact with the image is lower than that of the a surface of the fixing device 40 that comes into contact with the image.

Operation of Glossiness Reducing Device

The operation of the glossiness reducing device 90 will now be described.

The operation in the second exemplary embodiment is basically similar to that in the first exemplary embodiment. Glossiness is imparted to the entire area of the toner image that is fixed to the sheet of recording paper 5 by the fixing device 40. After glossiness is imparted to the entire area of the toner image on the sheet of recording paper 5, the sheet of recording paper 5 passes through the contact position 96 at which the heating device 94 and the back support roller 95 are in contact with each other. At this time, a part of the toner image fixed to the sheet of recording paper 5 is melted by being heated by the heating elements included in the heating device 94, the part being located in the area designated by the area designating device 104. The melted part of the toner image T on the sheet of recording paper 5 comes into contact with the surface 98*a* of the low releasability film 98. Then, the sheet of recording paper 5 is separated from the low releasability film 98.

The surface 98*a* of the low releasability film 98 has a relatively low releasability. Therefore, as illustrated in FIGS. 9A and 9B, when the low releasability film 98 is separated from the sheet of recording paper 5, the melted part of the toner image T on the sheet of recording paper 5 partially remains on the surface 98*a* of the low releasability film 98. As a result, projections and recesses are formed on the surface of the melted part of the toner image T on the sheet of recording paper 5, and the glossiness is reduced.

As described above, in the second exemplary embodiment, the glossiness of the toner image T fixed to the sheet of recording paper 5 may be reduced in the desired area by the glossiness reducing device 90 having a simple structure in which the low releasability film 98 is used.

Third Exemplary Embodiment

Figure 10:
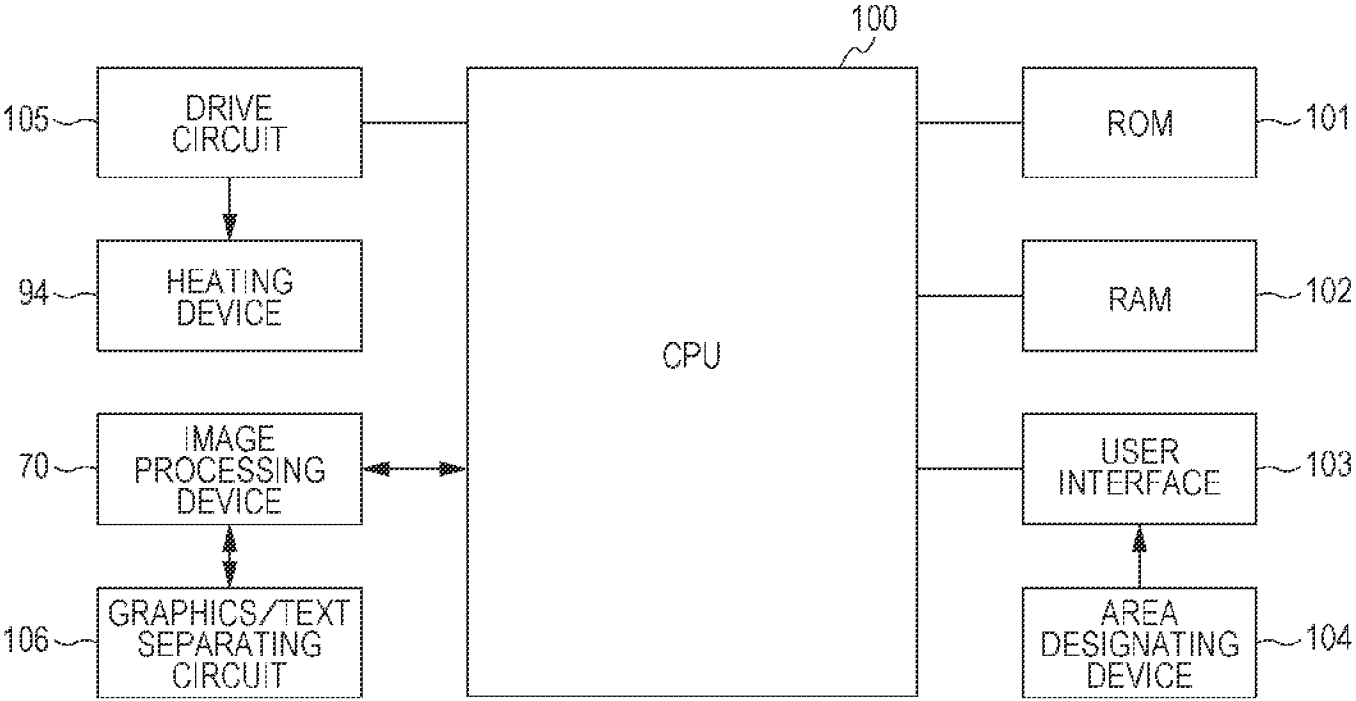
FIG. 10 is a block diagram illustrating a control circuit of an image forming apparatus according to a third exemplary embodiment of the present invention.

FIG. 10 is a block diagram illustrating a control circuit of an image forming apparatus according to a third exemplary embodiment of the present invention.

Structure of Control Circuit

An image forming apparatus 1 according to the third exemplary embodiment includes a determination unit that automatically determines the area in which the glossiness is to be reduced in the toner image formed on the sheet of recording paper 5.

Referring to FIG. 10, in the image forming apparatus 1, the area in which the glossiness is to be reduced is not designated by the area designating device 104, and an image processing device includes an graphics/text separating circuit 106 that separates graphic images and text images from each other.

The CPU 100 determines whether an image that is being formed by each imaging device 10 is a graphic image or a text image on the basis of a signal output by the graphics/text separating circuit 106, and causes the glossiness reducing device 90 to reduce the glossiness of only the image that has been determined as a text image. The glossiness reducing device 90 may also be caused to reduce the glossiness of a graphic image in accordance with the requirements from the user.

Thus, in the present exemplary embodiment, the user is not required to designate the area in which the glossiness is to be reduces. Therefore, the operability of the image forming apparatus may be increased.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording medium;

a glossiness imparting unit that imparts glossiness to the image formed on the recording medium; and a glossiness reducing unit that reduces the glossiness of at least a part of the image, to which the glossiness has been imparted by the glossiness imparting unit, by heating and roughening the part of the image, wherein a releasability of a surface of the glossiness reducing unit that comes into contact with the image is lower than a releasability of a surface of the glossiness imparting unit that comes into contact with the image.

2. The image forming apparatus according to claim 1, further comprising:

a designating unit that designates an area in which the glossiness is to be reduced in the image formed on the recording medium.

3. The image forming apparatus according to claim 1, further comprising:

a determination unit that determines an area in which the glossiness is to be reduced in the image formed on the recording medium.

4. An image forming method comprising:

forming an image on a recording medium;

imparting, by a glossiness imparting unit glossiness to the image formed on the recording medium; and reducing, by a glossiness reducing unit, the glossiness of at least a part of the image to which the glossiness has been imparted by heating and roughening the part of the image, wherein a releasability of a surface of the glossiness reducing unit that comes into contact with the image is lower than a releasability of a surface of the glossiness imparting unit that comes into contact with the image.

5. The image forming method to claim 4, further comprising:

designating an area in which the glossiness is to be reduced in the image formed on the recording medium.

6. The image forming method to claim 4, further comprising:

determining an area in which the glossiness is to be reduced in the image formed on the recording medium.

* * * * *